US010843471B2

(12) United States Patent
Ishizawa et al.

(10) Patent No.: US 10,843,471 B2
(45) Date of Patent: Nov. 24, 2020

(54) LIQUID EJECTION APPARATUS

(71) Applicant: SEIKO EPSON CORPORATION, Tokyo (JP)

(72) Inventors: Taku Ishizawa, Matsumoto (JP); Tadahiro Mizutani, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/667,281

(22) Filed: Oct. 29, 2019

(65) Prior Publication Data

US 2020/0130357 A1 Apr. 30, 2020

(30) Foreign Application Priority Data

Oct. 30, 2018 (JP) ..... 2018-203566

(51) Int. Cl.
*B41J 2/175* (2006.01)

(52) U.S. Cl.
CPC ..... *B41J 2/17506* (2013.01); *B41J 2/1752* (2013.01); *B41J 2/17509* (2013.01); *B41J 2/17523* (2013.01)

(58) Field of Classification Search
CPC .... B41J 2/175; B41J 2/17506; B41J 2/17509; B41J 2/1752; B41J 2/17523
See application file for complete search history.

(56) References Cited

U.S. PATENT DOCUMENTS 5,631,681 A * 5/1997 Klaus ..... B41J 2/17509 347/85
10,308,029 B2 6/2019 Kudo et al.
10,350,901 B2 7/2019 Mizutani et al.
2013/0242011 A1* 9/2013 Campbell-Brown ..... B41J 2/1752 347/92
2016/0152037 A1* 6/2016 Nakata ..... B41J 2/1752 347/85
2017/0355191 A1 12/2017 Mizutani et al.
2017/0355194 A1 12/2017 Fukasawa et al.
2017/0355195 A1 12/2017 Fukasawa et al.
2017/0355196 A1 12/2017 Shinada et al.
2017/0355197 A1 12/2017 Kudo et al.
2019/0299625 A1 10/2019 Mizutani et al.

FOREIGN PATENT DOCUMENTS

JP 2017-222152 A 12/2017

* cited by examiner

*Primary Examiner* — Anh T Vo
(74) *Attorney, Agent, or Firm* — Oliff PLC

(57) ABSTRACT

A liquid ejection apparatus comprises a carriage that includes a liquid ejection head and that moves inside a predetermined moving range, a plurality of liquid containers mounted on the carriage, the plurality of liquid containers including liquid refill ports respectively, an exterior member that covers the moving range, the exterior member including an opening configured to have a liquid outlet portion of the liquid refilling container be inserted therein, a selection information receiving portion that receives an input of a selected target liquid container, among the plurality of liquid containers, in which refilling of the liquid is to be performed, and a control unit that, using selection information that the selected information receiving portion has received, moves the carriage so that the liquid refill port of the target liquid container faces the opening.

8 Claims, 7 Drawing Sheets

LIQUID EJECTION APPARATUS

The present application is based on, and claims priority from JP Application Serial Number 2018-203566, filed Oct. 30, 2018, the disclosure of which is hereby incorporated by reference herein in its entirety.

BACKGROUND

1. Technical Field

The present disclosure relates to a liquid ejection apparatus.

2. Related Art

Hitherto, there is a known printer that includes a plurality of ink tanks to which refilling of ink from ink refilling containers can be performed (see JP-A-2017-222152). Such a printer does not provide the ink tanks on a carriage. The ink tanks include ink inlets allowing the ink that has flowed out from an ink outlet of the ink refilling container to flow therein. Each ink inlet is provided with a distinguishing portion that is a distinguishing structure that enables the ink refilling container, which has an ink outlet configured to connect to the ink inlet, to be distinguished.

In the known technique, when a plurality of ink tanks, to which ink can be refilled, are mounted on a carriage, the distinguishing structures are provided on the carriage. In such a case, there is an issue in that the energy to drive the carriage increases due to the increases in size, complexity, and weight of the carriage. Such an issue is not limited to a printer and is common in liquid ejection apparatuses that include a plurality of liquid containers mounted on a carriage.

SUMMARY

According to an aspect of the present disclosure, a liquid ejection apparatus to which a liquid from a liquid refilling container is refilled is provided. The liquid ejection apparatus includes a carriage that includes a liquid ejection head and that moves inside a predetermined moving range, a plurality of liquid containers mounted on the carriage, the plurality of liquid containers each including a liquid refill port through which the liquid is refilled, an exterior member that covers the moving range, the exterior member including an opening configured to have a liquid outlet portion of the liquid refilling container be inserted therein, a selection information receiving portion that receives an input of a selected target liquid container, among the plurality of liquid containers, in which refilling of the liquid is to be performed, and a control unit that, using selection information that the selection information receiving portion has received, moves the carriage so that the liquid refill port of the target liquid container faces the opening.

DESCRIPTION OF EXEMPLARY EMBODIMENTS

First Embodiment

Figure 1:
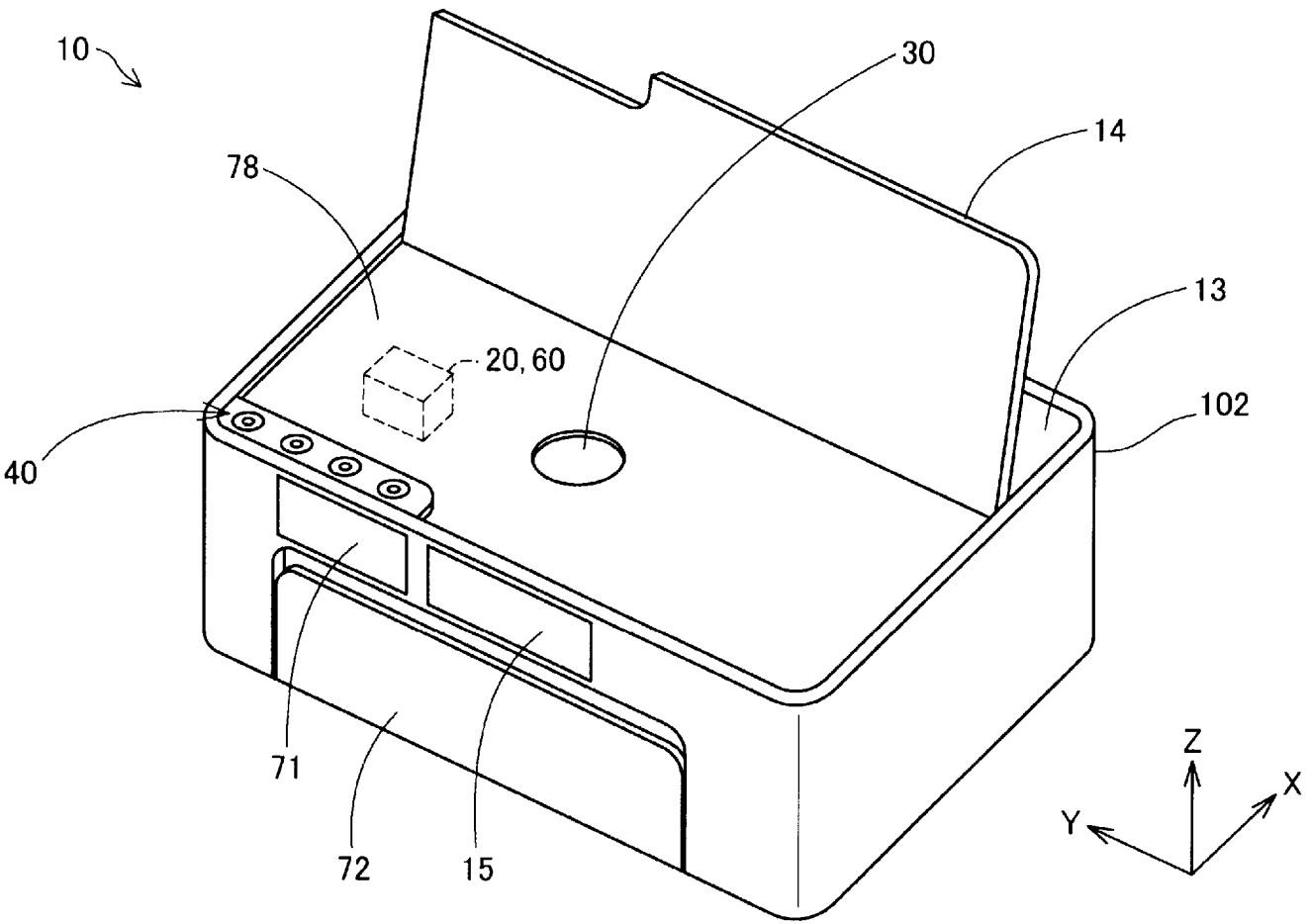
FIG. 1 is a schematic diagram of an external appearance of a liquid ejection apparatus according to a first embodiment.

FIG. 1 is a schematic diagram of an external appearance of a liquid ejection apparatus 10 according to a first embodiment. The liquid ejection apparatus 10 is a so-called ink jet printer. The liquid ejection apparatus 10 ejects ink serving as a liquid and performs printing on a medium such as paper. The liquid ejection apparatus 10 includes an exterior member 102, a selection information receiving portion 15, and a display portion 40. Aqueous ink or solvent ink, for example, can be used as the ink. Three spatial axes, namely, an X axis, a Y axis, a Z axis orthogonal to each other are depicted in FIG. 1. A direction extending along the X axis is an X direction, a direction extending along the Y axis is a Y direction, and a direction extending along the Z axis is a Z direction. The liquid ejection apparatus 10 is provided on an XY plane parallel to the X direction and the Y direction. The −Z direction is the vertically lower direction and the +Z direction is the vertically upper direction. In the drawings illustrated hereinafter, the X axis, the Y axis, and the Z axis are depicted as needed.

The exterior member 102 of the liquid ejection apparatus 10 is substantially a rectangular parallelepiped, and is a housing that protects components housed therein, such as, for example, a carriage 60 and liquid containers 20. The exterior member 102 includes a feed cover 13, a protective cover 14, a window portion 71, a discharge cover 72, and a maintenance cover 78. In the present embodiment, the exterior member 102 is the entire housing; however, the present embodiment is not limited to the above. It is only sufficient that the exterior member 102 covers at least a moving range of the carriage 60, and may be, for example, a portion of the housing, or a member configured to be detached such as a cover member or a case member.

The feed cover 13 is a cover that is configured to open and close and that covers a feeding portion that supplies the medium to the liquid ejection apparatus 10. The feed cover 13 is provided in a wall surface of the exterior member 102, which is located in the +Z direction when the liquid ejection apparatus 10 is provided on the XY plane.

The window portion 71 is a portion in which at least a portion of a wall of the exterior member 102 has been formed in a transparent manner or in a translucent manner. The window portion 71 is provided in a lateral surface of the exterior member 102, which extends in the Z direction and that forms a surface of the liquid ejection apparatus 10. The window portion 71 is configured to allow the liquid containers 20 disposed inside the exterior member 102 to be visible from the outside.

The discharge cover 72 is a cover that is configured to open and close and that covers a discharge portion that discharges a medium, on which printing has been performed, from the liquid ejection apparatus 10. Similar to the window portion 71, the discharge cover 72 is provided in the lateral surface that forms the surface of the liquid ejection apparatus 10.

The maintenance cover 78 is provided so as to be openable and closable. In the normal use state, the maintenance cover 78 is in a closed state. When the maintenance cover 78 is in the closed state, the maintenance cover 78 defines a top surface of the internal space of the exterior member 102 and covers the moving range of the carriage 60 provided in the internal space of the exterior member 102. The maintenance cover 78 is brought to an open state when maintenance is performed on the liquid ejection apparatus 10. When the maintenance cover 78 is in the open state, the components inside the exterior member 102 are exposed.

The maintenance cover 78 includes an opening portion 30 penetrating the maintenance cover 78 in the Z direction. The opening portion 30 is an opening that allows the inside and the outside of the exterior member 102 to communicate with each other and forms an opening allowing a liquid outlet portion of a liquid refilling container to be inserted therethrough. In the liquid ejection apparatus 10, refilling of a liquid through the opening portion 30 with the liquid refilling container can be performed. In a broad sense, refilling of the liquid means to increase the amount of liquid in the liquid container 20. Refilling the liquid includes filling the liquid in an empty liquid container for the first time, or supplying the liquid to the liquid container 20 in which the remaining amount of the liquid is less than the full amount. In the present embodiment, the number of opening portions 30 is one.

Similar to the feed cover 13, the protective cover 14 is provided in the wall of the exterior member 102, which is located in the +Z direction. The protective cover 14 is a plate-shaped member that includes a hinge mechanism configured to rotate about a rotation shaft extending in the Y direction. The protective cover 14 can be set to the open state and the closed state. In the closed state, the protective cover 14 is in a state opposing the maintenance cover 78 and covers the opening portion 30. With the above, foreign matters such as dust is suppressed from passing through the opening portion 30 and entering into the exterior member 102.

The selection information receiving portion 15 receives an input of the selected target liquid container, among the plurality of liquid containers 20, in which refilling of liquid is to be performed. The above input is performed by an operation of the user. The selection information receiving portion 15 in the present embodiment is a touch panel. Accordingly, the selection information receiving portion 15 is capable of displaying information needed to select the target liquid container such as, for example, information indicating the amount of remaining liquid. According to the input of the selection, the selection information receiving portion 15 outputs selection information to a control unit 510 described later.

The display portion 40 displays the colors of the liquids contained in the liquid containers 20. In the present embodiment, according to the selection information, the display portion 40 is configured to emit light with the color corresponding to the color of the liquid contained inside the liquid container 20. The display portion 40 includes the number of LED light sources equivalent to the number of types of colors of the liquids contained inside the liquid containers 20. By having the LED light source emit light with the color corresponding to the color of the liquid contained in the liquid container 20 serving as the target liquid container, the display portion 40 displays the color of the liquid contained in the liquid container 20 serving as the target liquid container. Accordingly, the possibility of the user mistaking the type of liquid that is to be refilled is reduced.

Figure 2:
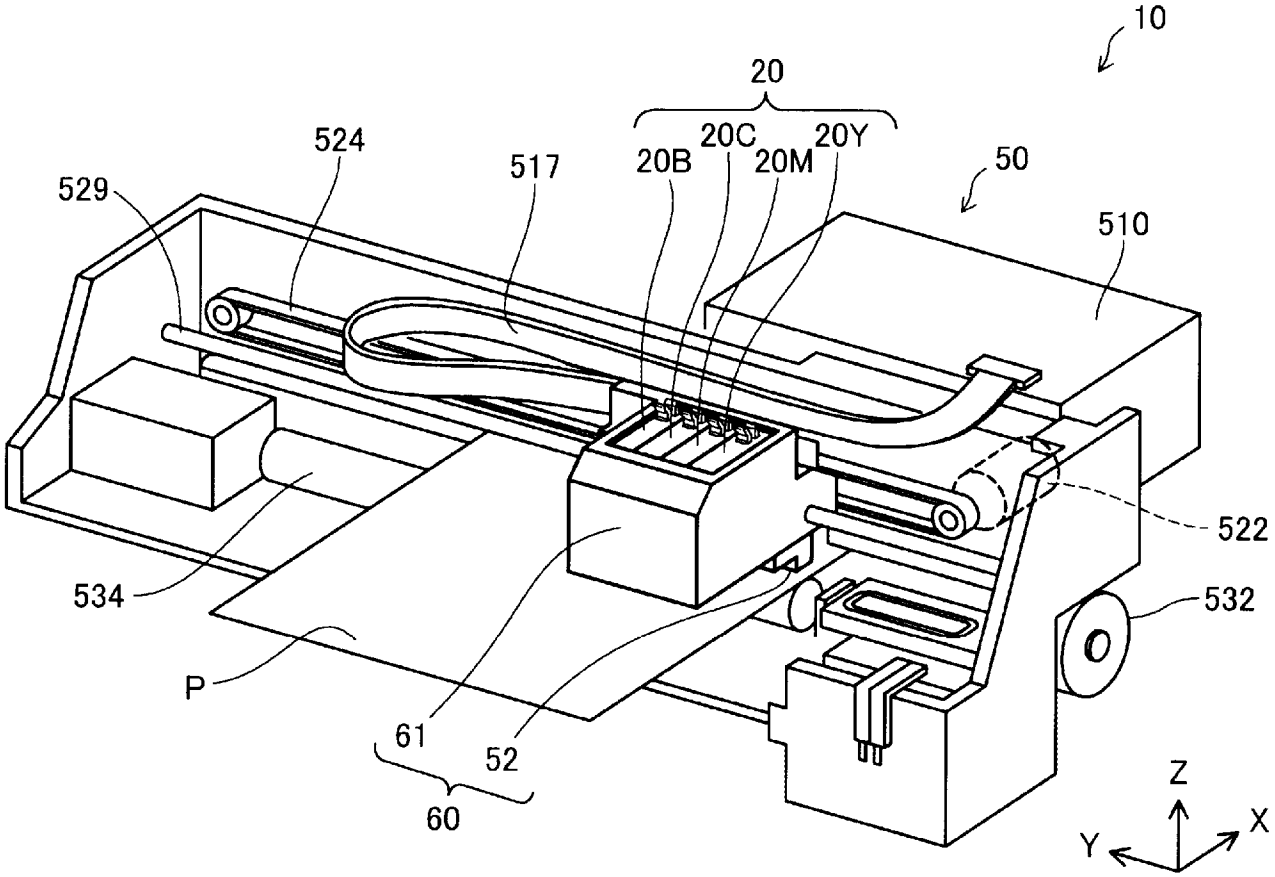
FIG. 2 is a schematic diagram illustrating an internal structure of the liquid ejection apparatus according to the first embodiment.

FIG. 2 is a schematic diagram of an internal structure of the liquid ejection apparatus 10 according to the first embodiment. FIG. 2 schematically illustrates components housed inside the exterior member 102 illustrated in FIG. 1. The liquid ejection apparatus 10 includes the liquid containers 20 and the carriage 60. The carriage 60 includes a holder unit 61 to which the liquid containers 20 can be mounted, and a liquid ejection head 52 that is configured to eject a liquid to a portion external to the liquid ejection head 52.

The liquid containers 20 each contain a liquid. The liquid containers 20 in the present embodiment are ink tanks. The liquid contained in each liquid container 20 flow through a liquid introduction portion provided in the holder unit 61 and is supplied to the liquid ejection head 52. In the present embodiment, the plurality of liquid containers 20 are mounted in the holder unit 61 of the liquid ejection apparatus 10 in a detachable manner. In the present embodiment, four types of liquid containers 20 are each mounted in the holder unit 61. The four types of liquid containers 20 correspond to the ink of four colors in total, namely, black, yellow, magenta, and cyan. The four liquid containers 20 are a liquid container 20B corresponding to black, a liquid container 20C corresponding to cyan, a liquid container 20M corresponding to magenta, and a liquid container 20Y corresponding to yellow. Hereinafter, when a configuration that is common among the liquid containers 20B, 20C, 20M, and 20Y is described, the liquid containers will be described as the liquid containers 20. Note that the number of liquid containers 20 mounted in the holder unit 61 is not limited to four.

The liquid ejection apparatus 10 makes the ink flow through the liquid ejection head 52 via the liquid introduction portion described later by suctioning the ink inside the liquid container 20 mounted in the holder unit 61. The liquid ejection head 52 includes ejection mechanisms such as piezoelectric elements, and ejects ink on a medium P. With the above, data of characters, figures, and images are printed on the medium P.

The control unit 510 included in the liquid ejection apparatus 10 controls each unit of the liquid ejection apparatus 10. The carriage 60 of the liquid ejection apparatus 10 is configured to move the liquid ejection head 52 relative to the medium P. The carriage 60 is configured to move inside a predetermined moving range. In the present embodiment, the carriage 60 is configured to move in a main scanning direction in the Y direction. The control unit 510 and the carriage 60 are electrically coupled to each other through a flexible cable 517. The ejection mechanisms of the liquid ejection head 52 each perform an ejection operation based on a control signal from the control unit 510.

Figure 3:
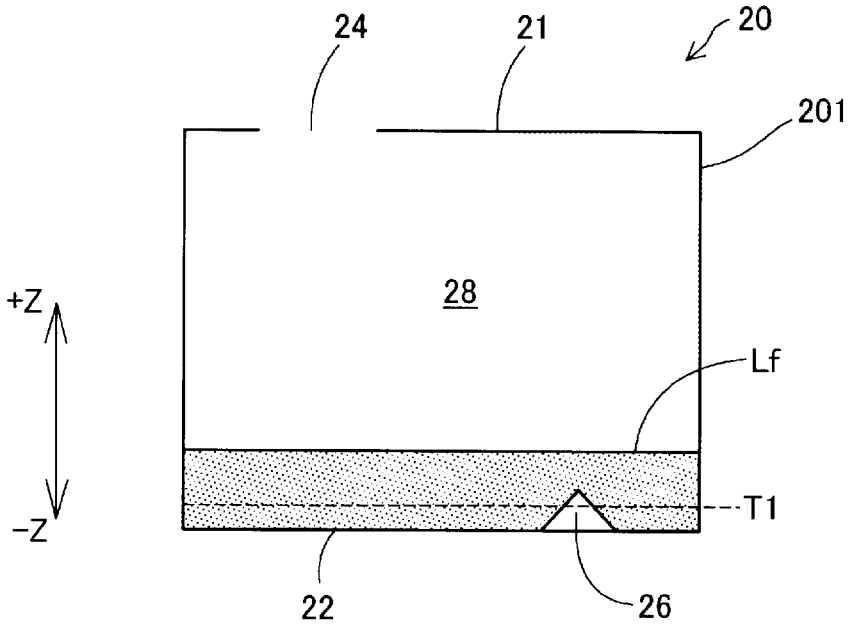
FIG. 3 is a schematic diagram for describing the liquid container.

FIG. 3 is a schematic diagram for describing the liquid container 20. Each liquid container 20 includes an outer shell 201 that defines a containing space 28 configured to contain a liquid. A liquid refill port 24 through which a liquid is refilled is formed in a first wall 21 that defines a top surface in the outer shell 201, which is a wall surface of the containing space 28 in the +Z direction. A detection portion 26 is disposed on a second wall 22 that defines a bottom surface in the outer shell 201, which is a wall surface of the containing space 28 on the −Z direction.

The detection portion 26 detects a liquid remaining amount, which is the remaining amount of liquid contained inside the liquid container 20. Specifically, the detection portion 26 is a prism. The liquid ejection apparatus 10 includes a light emitting element that irradiates light towards the prism, and a light receiving element that receives the reflected light reflected by the prism. The control unit 510 optically detects the liquid remaining amount by irradiating light on the prism using the light emitting element. In a first case in which a portion around the prism is filled with the liquid, for example, when a liquid face Lf is on the first wall 21 side with respect to a height T1, the light irradiated by the light emitting element is scattered in the liquid. On the other hand, in a second case in which the portion around the prism is not filled with the liquid, for example, when the liquid face Lf is on the second wall 22 side with respect to the height T1, the light irradiated by the light emitting element is reflected in the prism. Accordingly, the intensity of the light received by the light receiving element is larger in the second case than in the first case. With the above, according to the intensity of the light received by the light receiving element, the control unit 510 is capable of detecting the liquid remaining amount.

In the present embodiment, when the liquid face Lf is at T1 or higher, the control unit 510 determines that the remaining amount of the liquid is larger than a predetermined amount. On the other hand, when the liquid face Lf is under T1 due to the liquid in the liquid container 20 being used, the control unit 510 determines that the remaining amount of the liquid is smaller than the predetermined amount. The predetermined amount is an amount that serves as a criterion for judging whether the liquid needs to be refilled. The prism of the detection portion 26 is designed according to the height T1, which is a height of the liquid face Lf, corresponding to the predetermined amount.

Figure 4:
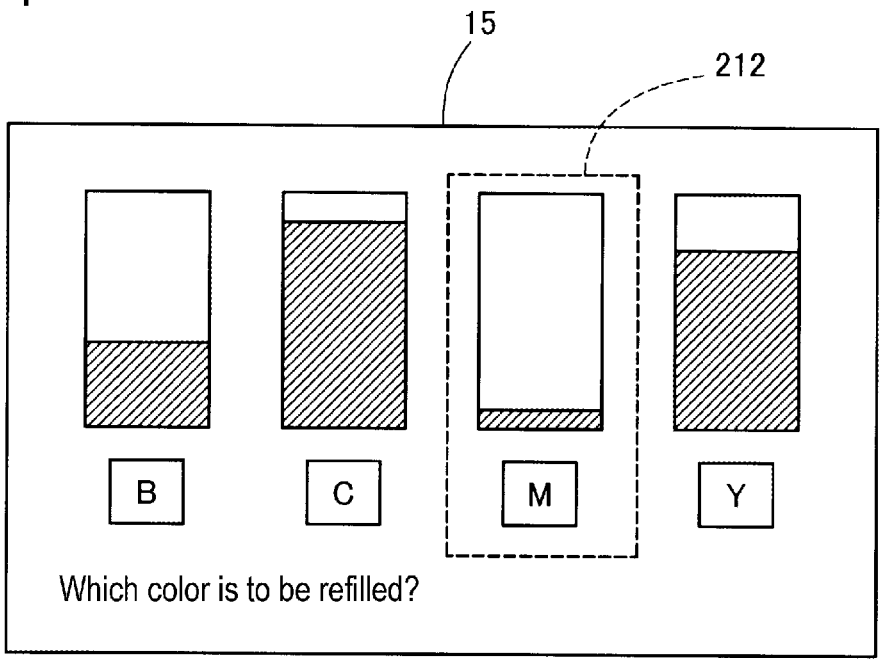
FIG. 4 is a schematic diagram of a selection information receiving portion.

FIG. 4 is a schematic diagram of the selection information receiving portion 15. FIG. 4 illustrates an example of a displayed content that is displayed on the selection information receiving portion 15 when receiving a selection information from the user. The selection information receiving portion 15 displays a message encouraging the user to perform an operation, and information indicating the liquid remaining amount of each liquid container 20. In the present embodiment, as the information indicating the liquid remaining amount in each liquid container 20, images schematically depicting the liquid remaining amounts are used. Furthermore, in the present embodiment, the message encouraging the user to perform an operation is "Which color is to be refilled?". The user can input the selection of the target liquid container by touching the image on the selection information receiving portion 15 corresponding to the liquid container 20 selected as the target liquid container in which the liquid is to be refilled. For example, when the user wants the magenta ink to be refilled, by touching an image 212, the user can input the selection information indicating that the liquid container 20M has been selected as the target liquid container. Note that after receiving an input of the selection information, the selection information receiving portion 15 may display an image confirming whether refilling has been finished, or may receive an input of whether refilling has been finished.

Figure 5:
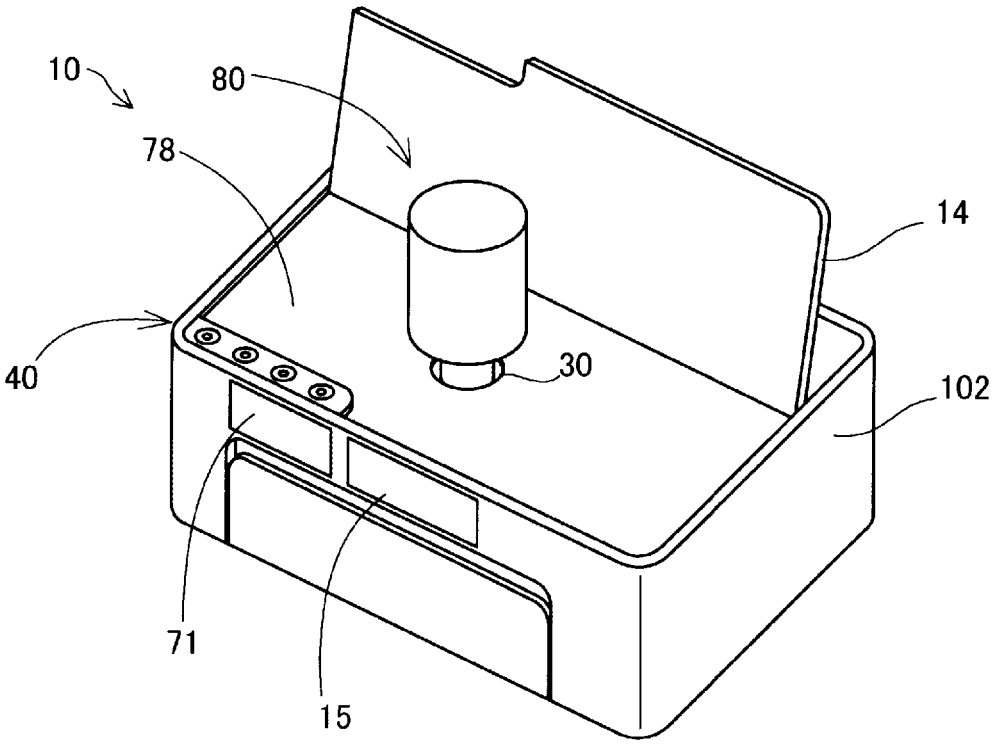
FIG. 5 is a schematic diagram illustrating an external appearance of the liquid ejection apparatus when refilling of a liquid is performed.
Figure 6:
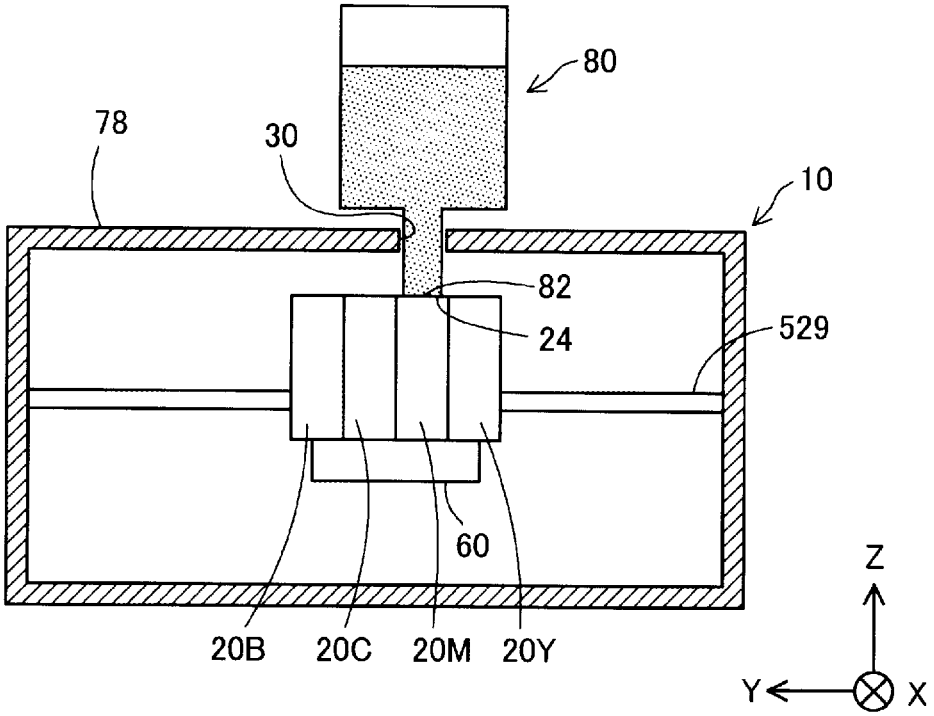
FIG. 6 is a schematic diagram illustrating an internal state of the liquid ejection apparatus when refilling is performed.

FIG. 5 is a schematic diagram illustrating an external appearance of the liquid ejection apparatus 10 when refilling of the liquid is performed. FIG. 6 is a schematic diagram illustrating an internal state of the liquid ejection apparatus 10 when refilling is performed. As illustrated in FIG. 5, when the liquid is refilled into the liquid container 20, the user inserts a liquid refilling container 80 into the internal space of the exterior member 102 through the opening portion 30.

As illustrated in FIG. 6, using the selection information that the selection information receiving portion 15 has received, the control unit 510 moves the carriage 60 so that the liquid refill port 24 of the liquid container 20M, which is the target liquid container, faces the opening portion 30. With the above, when the liquid refilling container 80 is inserted into the internal space of the exterior member 102 through the opening portion 30, a liquid outlet portion 82 of the liquid refilling container 80 is connected to the liquid refill port 24 of the liquid container 20M. The liquid in the liquid refilling container 80 is refilled into the liquid container 20M from the liquid outlet portion 82 through the liquid refill port 24.

According to the first embodiment described above, using the selection information that the selection information receiving portion 15 has received, the carriage 60 is moved so that the liquid refill port 24 of the liquid container 20, which is the target liquid container, faces the opening portion 30. Accordingly, an inappropriate liquid can be prevented from being refilled into the target liquid container without providing, on the carriage 60, a structure enabling the liquid refilling container 80 corresponding to the target liquid container to be distinguished. Accordingly, increases in size, complexity, and weight of the carriage 60 due to providing a structure enabling distinction can be suppressed.

Furthermore, in the first embodiment described above, the number of opening portions 30 through which the liquid refilling container 80 is inserted is one. Accordingly, compared with when there are a plurality of opening portions 30, the possibility of the user becoming confused of which opening portion 30 to insert the liquid refilling container 80 can be reduced.

Second Embodiment

Figure 7:
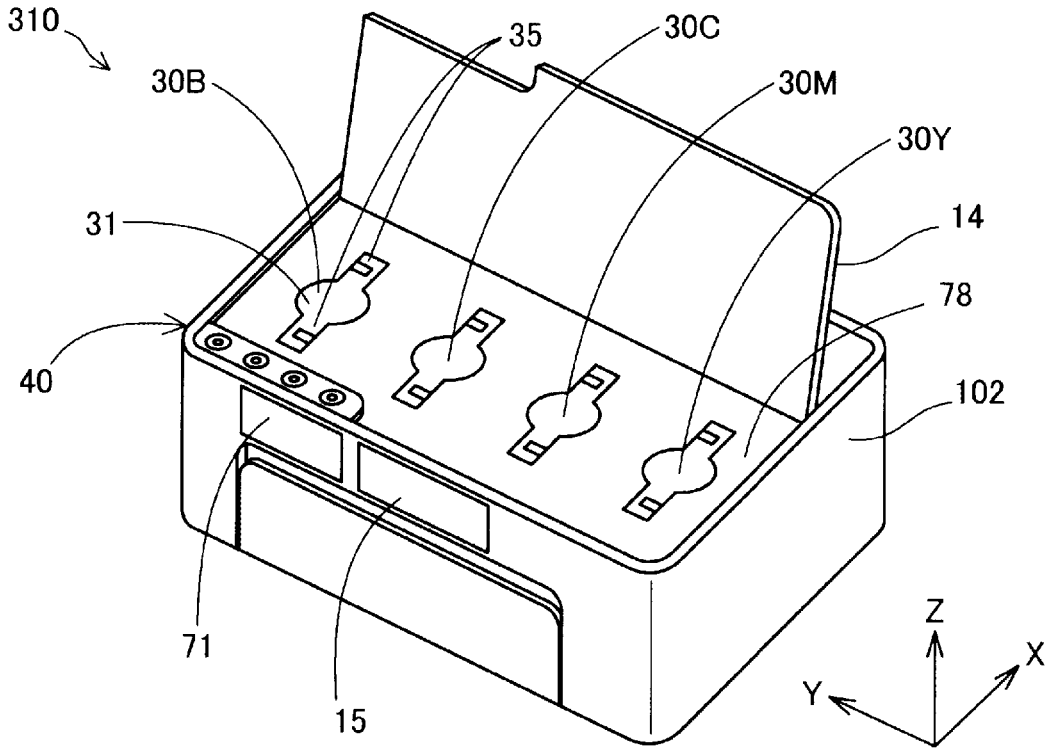
FIG. 7 is a schematic diagram of an external appearance of a liquid ejection apparatus according to a second embodiment.

FIG. 7 is a schematic diagram of an external appearance of a liquid ejection apparatus 310 according to a second embodiment. Hereinafter, components that are the same as those of the first embodiment will be denoted with the same reference numerals and detailed description thereof will be omitted.

The liquid ejection apparatus 310 includes a plurality of opening portions 30. In the present embodiment, the number of opening portions 30 is the same as the number of liquid containers 20 and, specifically, is four. The four opening portions 30 will also be described as a first opening portion 30B, a second opening portion 30C, a third opening portion 30M, and a fourth opening portion 30Y from the +Y direction towards the −Y direction in the above order. The first opening portion 30B includes an opening 31 into which the liquid outlet portion 82 of the liquid refilling container 80*a* for refilling a black liquid is inserted. The second opening portion 30C includes an opening 31 into which the liquid outlet portion 82 of the liquid refilling container 80*a* for refilling a cyan liquid is inserted. The third opening portion 30M includes an opening 31 into which the liquid outlet portion 82 of the liquid refilling container 80*a* for refilling a magenta liquid is inserted. The fourth opening portion 30Y includes an opening 31 into which the liquid outlet portion 82 of the liquid refilling container 80*a* for refilling a yellow liquid is inserted.

Each opening portion 30 includes an opening 31 into which the liquid outlet portion 82 of the liquid refilling container 80 can be inserted, and a first distinguishing structure 35 provided in the vicinity of or extending from the opening 31 in an intersecting direction thereof. Each first distinguishing structure 35 has a protruded and recessed shape and is a structure that enables the liquid refilling container 80*a* to be distinguished. The first distinguishing structures 35 of the four opening portions 30 each have different shapes.

Figure 8:
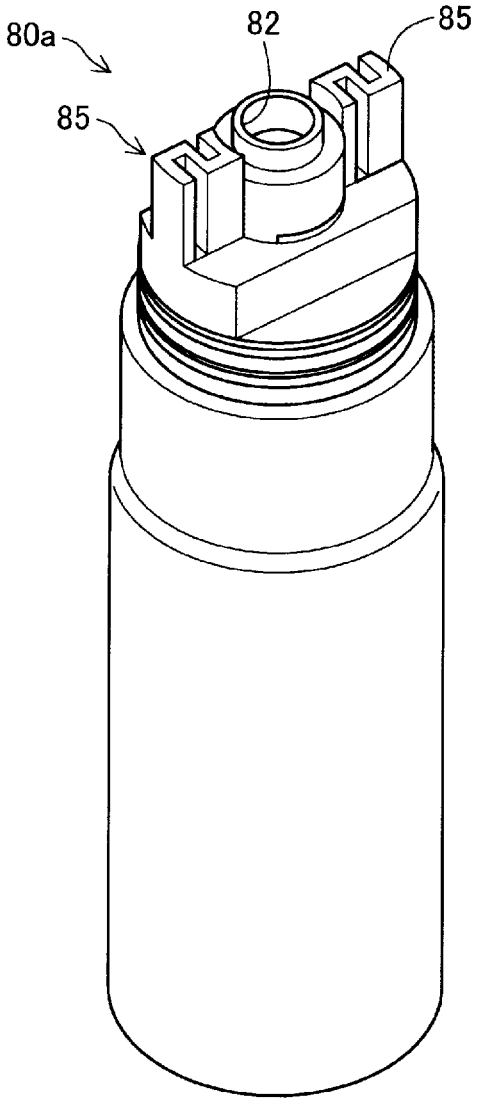
FIG. 8 is a schematic diagram of an external appearance of the liquid refilling container.

FIG. 8 is a schematic diagram of an external appearance of the liquid refilling container 80*a*. Each liquid refilling container 80*a* used in the present embodiment includes a second distinguishing structure 85 provided in the vicinity of the liquid outlet portion 82 and provided in an intersecting direction of the liquid outlet portion 82. The second distinguishing structure 85 has a protruded and recessed shape. The protruded and recessed shape of the second distinguishing structure 85 is determined according to the type of liquid inside the liquid refilling container 80*a*. Each second distinguishing structure 85 is configured to fit into the corresponding first distinguishing structure 35. Since the first distinguishing structures 35 provided in the four opening portions 30 have different structures, the liquid refilling container 80 that can be inserted into each opening portion 30 differs. With the above, the opening portions 30 can distinguish the liquid refilling containers 80*a* with the first distinguishing structures 35.

Figure 9:
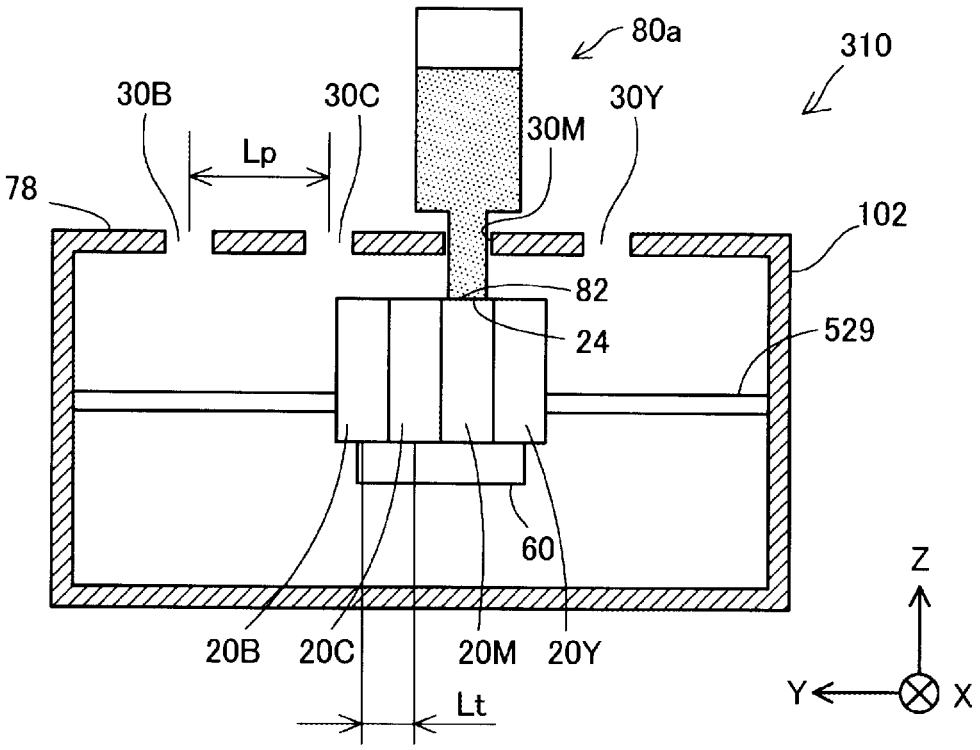
FIG. 9 is a schematic diagram illustrating an internal state of the liquid ejection apparatus when refilling is performed.

FIG. 9 is a schematic diagram illustrating an internal state of the liquid ejection apparatus 10 when refilling is performed. FIG. 9 illustrates a state when the magenta liquid is refilled into the liquid container 20M. Using the selection information that the selection information receiving portion 15 has received, the control unit 510 moves the carriage 60 so that the liquid refill port 24 of the liquid container 20M, which is the target liquid container, faces the opening 31 of the corresponding third opening portion 30M. With the above, when the liquid refilling container 80*a* is inserted into the internal space of the exterior member 102 through the third opening portion 30M, the liquid outlet portion 82 of the liquid refilling container 80*a* is connected to the liquid refill port 24 of the liquid container 20M. The liquid in the liquid refilling container 80 is refilled into the liquid container 20M from the liquid outlet portion 82 through the liquid refill port 24.

As illustrated in FIG. 9, the four liquid containers 20 are mounted on the carriage 60 so that the liquid refill ports 24 are disposed at first intervals Lt. Furthermore, the four opening portions 30 are disposed at second intervals Lp that are different from the first intervals Lt. Accordingly, the liquid refill ports 24 of the liquid containers 20B, 20C, and 20Y other than the magenta liquid container 20M, which is the target liquid container, are located at positions different from the positions facing the corresponding opening portions 30B, 30C, and 30Y. Accordingly, occurrence of an erroneous operation of refilling the liquid to the liquid container 20B, 20C, or 20Y that is a liquid container different from the liquid container 20M, which is the target liquid container, can be prevented. Furthermore, since the second interval Lp is larger than the first interval Lt, compared with when the second interval Lp is smaller than the first interval Lt, a decrease in the strength of the exterior member 102 in the portions between the opening portions 30 can be suppressed. Furthermore, by increasing the second interval Lp, it will be easier to dispose components, other than the distinguishing structure, in the vicinity of the openings 31.

Since the second embodiment described above has a configuration similar to that of the first embodiment, a similar effect can be obtained. Furthermore, the liquid ejection apparatus 310 according to the second embodiment includes the first distinguishing structures 35 in the opening portions 30. Accordingly, the liquid ejection apparatus 310 can, with the first distinguishing structures 35, suppress an inappropriate liquid from being refilled in the target liquid container without providing the distinguishing structure on the carriage 60. Accordingly, increases in size, complexity, and weight of the carriage 60 due to providing a structure enabling distinction can be suppressed.

OTHER EMBODIMENTS

First Other Embodiment

In the second embodiment, the number of opening portions 30 is the same as the number of liquid containers 20. However, when there is a plurality of opening portions 30, the number of opening portions 30 can be different from the number of liquid containers 20. For example, the number of opening portions 30 may be less than the number of liquid containers 20. Specifically, for example, the liquid ejection apparatus 310 may include two opening portions 30, namely, an opening portion 30 to refill a liquid to the black liquid container 20B, and an opening portion 30 to refill liquids to the liquid containers 20C, 20M, and 20Y other than the black liquid container 20B. Furthermore, even when there are a plurality of opening portions 30, the first distinguishing structures 35 do not necessarily have to be provided.

Second Other Embodiment

In the second embodiment described above, the plurality of opening portions 30 are provided at the second intervals Lp that are larger than the first intervals Lt. However, the second intervals Lp at which the opening portions 30 are provided are not limited to the above. For example, the second interval Lp may have the same size as that of the first interval Lt.

Third Other Embodiment

In the embodiments described above, the liquid ejection apparatus 10 includes a display portion 40 that is configured to, according to the selection information, emit light with the color corresponding to the color of the liquid contained inside the liquid container 20. However, the liquid ejection apparatus 10 is not limited to the above. For example, the display portion 40 may display the color of the liquid contained in the liquid container 20 with a method other than emitting light corresponding to the color of the liquid. For example, the display portion 40 may include a screen configured to display characters, and character information may be used to display the color of the liquid contained in the liquid container 20. In such a case, the touch panel provided as the selection information receiving portion 15 may include a function of the display portion 40. Furthermore, for example, the liquid ejection apparatus 10 do not have to include a display portion 40. In such a case, in place of the display portion 40, the liquid ejection apparatus 10 may include another component that notifies the user the color of the liquid contained in the liquid container 20. For example, in place of the display portion 40, the liquid ejection apparatus 10 may include a loudspeaker configured to notify the user the color of the liquid contained in the liquid container 20 with voice.

Fourth Other Embodiment

In the embodiments described above, the selection information receiving portion 15 may not receive selection information of a liquid container 20, among the plurality of liquid containers 20, in which the liquid remaining amount is larger than the predetermined amount. For example, when a liquid container 20 having a liquid remaining amount that is larger than the predetermined amount is selected, the selection information receiving portion 15 may not receive the selection information by having the control unit 510 not instruct an operation that refills the liquid, such as moving of the carriage 60. Furthermore, for example, the selection information receiving portion 15 may be controlled by the control unit 510 so that the liquid container 20 having a liquid remaining amount that is larger than the predetermined amount cannot be selected. When the selection information of the liquid container 20 having a liquid remaining amount that is larger than the predetermined amount is not received by the selection information receiving portion 15, selection of the liquid container 20 to which the liquid is to be refilled becomes easy.

The predetermined amount may be set according to the liquid containing amount of the liquid refilling container 80 or 80*a*. For example, the selection information receiving portion 15 may not receive the selection information of the liquid container 20, among the plurality of liquid containers 20, in which the liquid remaining amount is larger than the liquid containing amount of the liquid refilling container 80 or 80*a*. In such a case, all of the liquid inside the liquid refilling container 80 or 80*a* can be filled into the liquid container 20 that may be selected. Accordingly, when a liquid is refilled into the liquid container 20 from the liquid refilling container 80 or 80*a*, the possibility of the liquid overflowing from the liquid container 20 can be reduced. Furthermore, since the liquid refilling container 80 or 80*a* can be used up, the trouble of storing the liquid refilling container 80 or 80*a* that is still being used can be reduced.

Fifth Other Embodiment

In the embodiments described above, the liquid ejection apparatuses 10 and 310 include a prism serving as a detection portion 26. However, the liquid ejection apparatuses 10 and 310 may include a detection portion 26 other than the prism. For example, the liquid ejection apparatus 10 and 310 may include, as the detection portion 26, a float in which the height in the liquid changes according to the height of the liquid face Lf. In such a case, the control unit 510 may detect the liquid remaining amount using the height of the float. Furthermore, electrodes provided in the liquid may be included as the detection portion 26. In such a case, the control unit 510 may detect the liquid remaining amount according to the impedance in the liquid. In place of the detection portion 26 or in addition to the detection portion 26, the liquid ejection apparatuses 10 and 310 may be configured to detect the liquid remaining amount using a software based method. For example, the control unit 510 counting the number of droplets ejected may detect the liquid remaining amount using the count result. Alternatively, the liquid ejection apparatuses 10 and 310 do not have to include a method of detecting the liquid remaining amount. In such a case, the user can visually confirm the liquid remaining amount in the liquid container 20.

Sixth Other Embodiment

In the embodiments described above, the selection information receiving portion 15 is provided on the exterior member 102 of the liquid ejection apparatuses 10 and 310. However, the selection information receiving portion 15 may be provided in a member separate from the liquid ejection apparatuses 10 and 310. In such a case, information processing equipment such as a personal computer, or a portable terminal device such as a smartphone connected to the liquid ejection apparatuses 10 and 310 may be used as the selection information receiving portion 15.

Since the first to sixth other embodiments described above have configurations similar to those of the first and second embodiments, a similar effect can be obtained.

Seventh Other Embodiment

Not limited to an ink jet printer and an ink tank that supplies ink to an ink jet printer, the present disclosure can be applied to any liquid ejection apparatus that ejects a liquid including ink, and a liquid tank that contains the liquid. For example, the present disclosure can be applied to various liquid ejection apparatuses and the liquid containers thereof described hereinafter.

(1) A recording device such as a facsimile machine.

(2) A coloring material ejection device used to manufacture a color filter of an image display device such as a liquid crystal display.

(3) An electrode material ejection device used to form electrodes of organic electroluminescence (EL) displays and surface emitting displays (field emission display or FED).

(4) A liquid ejection apparatus that ejects a liquid containing bio organic matter to manufacture biochips.

(5) A sample ejection device serving as a precision pipette.

(6) Ejection device of lubricating oil.

(7) Ejection device of a resin liquid.

(8) A liquid ejection apparatus that ejects lubricant oil in a pinpoint manner to precision instruments such as a watch and a camera.

(9) A liquid ejection apparatus that sprays transparent liquid resin such as ultraviolet curing resin on a substrate in order to form a hemispherical microlens (optical lens) used in optical communication elements and the like.

(10) A liquid ejection apparatus that ejects acid or alkaline etching solution for etching substrates and the like.

(11) A liquid ejection apparatus including a liquid ejection head that ejects any micro amount of droplets other than the above.

Note that a droplet refers to a state of a liquid that is ejected from the liquid ejection apparatus and its shape includes, a granular shape, a tear shape, or a shape with a threadlike trail. Furthermore, "liquid" used herein refers to any material that can be ejected by the liquid ejection apparatus. For example, any material in which the substance is in a liquid phase is sufficient as the "liquid", and the "liquid" may include a material in a liquid state with high or low viscosity, and materials in a liquid state such as sol, gel water, other inorganic solvents, an organic solvent, a solution, liquid resin, and liquid metal (metallic melt). Furthermore, not just liquid as a state of matter, the "liquid" includes particles of functional material including a solid body such as pigment or metal particle that is dissolved, dispersed, or mixed in a solvent. Furthermore, a representative example of the liquid includes ink, liquid crystal, and others that have been described in the exemplary embodiment described above. Note that ink includes various liquid-form compositions such as a general aqueous ink, solvent ink, and gel ink, and a hot melt ink.

The discloser is not limited to the embodiments described above and can be implemented in various configurations that do not depart from the scope of the disclosure. For example, the technical features described above corresponding to the technical features of the embodiments can be appropriately replaced or combined in order to overcome a portion or all of the issues described above or to achieve a portion of all of the effects described above. Furthermore, the technical features that are not described in the present specification as an essential feature may be omitted as appropriate.

(1) According to an aspect of the present disclosure, a liquid ejection apparatus to which a liquid from a liquid refilling container is refilled is provided. The liquid ejection apparatus includes a carriage that includes a liquid ejection head and that moves inside a predetermined moving range, a plurality of liquid containers mounted on the carriage, the plurality of liquid containers including liquid refill ports through which the liquid is refilled, an exterior member that covers the moving range, the exterior member including an opening configured to have a liquid outlet portion of the liquid refilling container be inserted therein, a selection information receiving portion that receives an input of a selected target liquid container, among the plurality of liquid containers, in which refilling of the liquid is to be performed, and a control unit that, using selection information that the selection information receiving portion has received, moves the carriage so that the liquid refill port of the target liquid container faces the opening. The liquid ejection apparatus configured in such a manner includes a control unit that, using selection information that the selection information receiving portion has received, moves the carriage so that the liquid refill port of the target liquid container faces the opening. Accordingly, an inappropriate liquid can be prevented from being refilled into the target liquid container without providing, on the carriage, a structure enabling the liquid refilling container corresponding to the target liquid container to be distinguished. Accordingly, increases in size, complexity, and weight of the carriage due to providing a structure enabling distinction can be suppressed.

(2) In the liquid ejection apparatus configured in the above described manner, the number of the openings may be one. In the liquid ejection apparatus configured in such a manner, the number of openings through which the liquid refilling container is inserted is one. Accordingly, compared with when there are a plurality of openings, the possibility of the user becoming confused of which opening to insert the liquid refilling container can be reduced.

(3) In the liquid ejection apparatus configured in the above described manner, the number of openings may be the same as the number of liquid containers. The liquid ejection apparatus may further include distinguishing portions extending from the openings in intersecting directions of the openings, the distinguishing portions configured to distinguish whether a plurality of liquid outlet portions of a plurality of liquid refilling containers corresponding to the openings are insertable into the corresponding openings. The liquid ejection apparatus configured in such a manner is configured to, without providing the distinguishing structures on the carriage, suppress an inappropriate liquid from being refilled into the target liquid container with the distinguishing structures provided in the vicinities of the openings.

(4) In the liquid ejection apparatus configured in the above described manner, the plurality of liquid containers may be mounted on the carriage so that the liquid refill ports are disposed at first intervals, and the plurality of openings may be disposed at second intervals larger than the first intervals. According to the liquid ejection apparatus configured in such a manner, compared with when the second interval is smaller than the first interval, a decrease in the strength of the exterior member in the portions between the opening portions can be suppressed.

(5) The liquid ejection apparatus configured in the above described manner may further include a display portion that displays a color of a liquid contained in the target liquid container. Since the liquid ejection apparatus configured in such a manner includes the display portion, the possibility of the user mistaking the type of liquid that is to be refilled is reduced.

(6) In the liquid ejection apparatus configured in the above described manner, the selection information receiving portion may not receive the selection information of the liquid container, among the plurality of liquid containers, in which a liquid remaining amount is larger than a predetermined amount. According to the liquid ejection apparatus configured in such a manner, since the selection information receiving portion does not receive the selection information of the liquid container in which a liquid remaining amount is larger than a predetermined amount, it will be easier to select the liquid container to which the liquid is to be refilled.

(7) The liquid ejection apparatus configured in the above described manner may further include detection portions that each detect the liquid remaining amount of a corresponding one of the plurality of liquid containers. According to the liquid ejection apparatus configured in such a manner, the trouble of confirming the liquid remaining amounts of the liquid containers is reduced.

(8) In the liquid ejection apparatus configured as described above, the selection information receiving portion may not receive the selection information of the liquid container, among the plurality of liquid containers, in which a refillable amount of the liquid determined according to the liquid remaining amount is smaller than a liquid containing amount of the liquid refilling container. According to the liquid ejection apparatus configured in such a manner, when a liquid is refilled into the liquid container from the liquid refilling container, the possibility of the liquid overflowing from the liquid container can be reduced. Furthermore, since the liquid refilling container can be used up in a single refilling, the trouble of storing the liquid refilling container that is still being used can be reduced.

The present disclosure can be implemented in various configurations other than the liquid ejection apparatus. The present disclosure can be implemented as a method of controlling or a control program of a liquid ejection apparatus, for example.

What is claimed is:

1. A liquid ejection apparatus to which a liquid from a liquid refilling container is refilled, the liquid ejection apparatus comprising:

a carriage that includes a liquid ejection head and that moves inside a predetermined moving range;

a plurality of liquid containers mounted on the carriage, the plurality of liquid containers each including a liquid refill port through which the liquid is refilled;

an exterior member that covers the moving range, the exterior member including an opening configured to have a liquid outlet portion of the liquid refilling container be inserted therein;

a selection information receiving portion that receives an input of a selected target liquid container, among the plurality of liquid containers, in which refilling of the liquid is to be performed; and a control unit that, using selection information that the selection information receiving portion has received, moves the carriage so that the liquid refill port of the target liquid container faces the opening.

2. The liquid ejection apparatus according to claim 1, wherein regarding the opening, a number thereof is one.

3. The liquid ejection apparatus according to claim 1, wherein regarding the opening, the number of thereof is equivalent to the number of the plurality of liquid containers, and the liquid ejection apparatus further includes distinguishing portions provided in an intersecting direction of the openings, the distinguishing portions configured to distinguish whether a plurality of the liquid outlet portions of a plurality of the liquid refilling containers corresponding to the openings are insertable into the corresponding openings.

4. The liquid ejection apparatus according to claim 3, wherein the plurality of liquid containers are mounted on the carriage so that the liquid refill ports are disposed at first intervals, and the plurality of openings are disposed at second intervals larger than the first intervals.

5. The liquid ejection apparatus according to claim 1, further comprising:

a display portion that displays a color of a liquid contained in the target liquid container.

6. The liquid ejection apparatus according to claim 1, wherein the selection information receiving portion does not receive the selection information of the liquid container, among the plurality of liquid containers, in which a liquid remaining amount is larger than a predetermined amount.

7. The liquid ejection apparatus according to claim 6, further comprising:

detection portions that each detect the liquid remaining amount of a corresponding one of the plurality of liquid containers.

8. The liquid ejection apparatus according to claim 1, wherein the selection information receiving portion does not receive the selection information of the liquid container, among the plurality of liquid containers, in which a refillable amount of the liquid determined according to the liquid remaining amount is smaller than a liquid containing amount of the liquid refilling container.

* * * * *